US005313811A

United States Patent [19]

Wasinger et al.

[11] Patent Number: 5,313,811

[45] Date of Patent: May 24, 1994

[54] APPARATUS FOR TREATMENT OF DYED GARMENTS AND FABRICS WITH OXIDIZING GASES

[75] Inventors: Eric Wasinger, Adamsville, Tenn.; David Hall, Auburn, Ala.

[73] Assignee: Eric Wasinger, San Antonio, Tex.

[21] Appl. No.: 848,875

[22] Filed: Mar. 10, 1992

[51] Int. Cl.[5] ..... D06F 35/00

[52] U.S. Cl. ..... 68/5 C; 68/13 R

[58] Field of Search ..... 68/13 R, 5 C

[56] References Cited

U.S. PATENT DOCUMENTS 3,065,620 11/1962 Houser ..... 68/13 R
3,130,570 4/1964 Rentzepis ..... 68/13 R
3,194,628 7/1965 Cannon ..... 68/13 R X
3,226,842 1/1966 Morey ..... 68/13 R X
3,916,652 11/1975 Speakman ..... 68/13 R

*Primary Examiner*—Philip R. Coe
*Attorney, Agent, or Firm*—John Lezdey

[57] ABSTRACT

The invention provides an apparatus for laundering and treating garments or fabrics with an oxidizing agent. The apparatus includes a housing having a chamber containing a barrel mounted for rotation. A door is provided for placing the garments or fabrics into the chamber. Associated with the housing is a venturi mixer for introducing an oxidizing gas and a liquid into the chamber and a value for removing liquid from the chamber. Controls are is provided to selectively permit a washing, extracting and abrading cycle.

16 Claims, 3 Drawing Sheets

APPARATUS FOR TREATMENT OF DYED GARMENTS AND FABRICS WITH OXIDIZING GASES

FIELD OF THE INVENTION

This invention relates to an apparatus for the treatment of fabrics with oxidizing gases. More particularly, there is provided an apparatus for treating fabrics in an extraction stage of a laundering operation with oxidizing gases such as ozone so as to decolorize dyes or coloring agents on the fabrics.

BACKGROUND OF THE INVENTION

Denim blue jeans which have been faded, "stone-washed", ice washed, or sand blasted to produce a particular appearance are very popular. However, to produce the desired effect it has been necessary to utilize processes which cause substantial deterioration or degradation of the fabric. Bleaching solutions containing chlorine or actual pelleting of the garment with sand or stones to produce a fashion effect causes damage to the fabric which affects its wear life.

The woven goods that are made into denim are typically manufactured from warp yarns (yarns that are in the machine direction on the loom) that have been dyed with Indigo (CI vat blue 1). The crosswise or filling yarns are typically undyed. The yarns are woven in such a way so as to place a high proportion of the colored (blue dyed) yarns on the face of the fabric. This is typically done by weaving the yarns using one of the twill weaves. The result is a fabric which is characteristically known as "Blue Jeans" when fabricated into garments. It has been discovered that bleaching of the Indigo color by one of a number of techniques can lead to desirable styling effects. Several of the bleaching or decolorizing treatments involves potassium (or sodium) permanganate. This compound is the agent of choice when obtaining staying effects by the acid wash or stone wash technique.

Occasionally, garments which have been treated by these methods undergo yellowing during storage of the garments during warehousing and prior to shipment to the retailer or while in the retailers possession if he stores them for any length of time.

The precise causes for the yellowing phenomena is not known. Several possible causes have been identified to include finishing agents (added to the garment to provide a softer hand etc.), atmospheric pollutants or to degradation products associated with the permanganate reactions which are not properly removed during the treatments among other causes. However, not all garments will be yellowed in a particular lot or shipment. The yellowing phenomena may not manifest itself until after the garments have been stored or shipped to the customer. Most likely the yellowed garments do emanate from a particular laundry cycle or machine; however, after the treated garments are removed from the machine the garments from the affected treatment cycle may then become mixed with those from other machines such that their processing lot identity becomes lost. Usually the contaminated (yellow) garments are returned to the seller or are sold at a considerably reduced price.

Various systems have been developed to treat fabric or garments with ozone. The systems generally use steam mixed with ozone enriched air or oxygen and the fabric or garments are suspended in a treatment chamber. The steam has the function of wetting the fabric or garments and to elevate the temperature to increase the reaction rate.

U.S. Pat. No. 1,823,352 to Crespi et al discloses an apparatus for bleaching textile fibers with a gaseous current, such as ozonized air. In the apparatus, textile material is suspended in a chamber where it is acted on by a gaseous ozonized air mixture which passes through the chamber.

U.S. Pat. No. 4,283,251 to Singh discloses a process relating to the ozone and peroxygen bleaching of cellulosic pulp. The process includes the steps of recycling extract effluent from the bleaching treatment.

U.S. Pat. No. 4,300,367 to Thorsen discloses the treatment of fibers with ozone—steam mixtures by conveying them through an open—ended chamber. The fibers are exposed to the ozone—steam mixture in the horizontal middle section of the chamber where the ozone is centrally introduced.

U.S. patent application Ser. No. 560,357 of Hall et al, which is herein incorporated by reference, discloses the fading of dyed cellulosic garments by the ozone degradation of the dye without any substantial degradation of the cellulosic materials in a vapor phase.

It should be understood that the term "dye" as used herein is meant to include any of the materials which are used to provide a color to a fabric such as conventional dyes, pigments, or the like. The term "fabric" as used herein is meant to include woven and non-woven cloth, knitted fabrics, garments, and the like.

It should be understood that the term "ozone and steam" as used herein denotes a preferable method of the invention and is meant to include ozone alone or ozone diluted with inert gases.

SUMMARY OF THE INVENTION

In accordance with the invention there is provided a multi-purpose apparatus for laundering and selectively decolorizing a fabric, especially those containing cellulosic material having an oxidizable coloring agent such as a dye, pigment, organic or inorganic residues, and the like. The fabric may comprise cotton, linen, or other bast fibers or rayon alone or in combination with other materials including natural and synthetic fibers, for example, wool, nylon, polyester, and the like.

The invention provides an apparatus for laundering and treating garments or fabrics with an oxidizing agent. The apparatus includes a housing having a chamber. The chamber contains a barrel or drum mounted for rotation in the chamber with means for rotating the barrel. Door means is provided on said housing for placing garments or fabrics into the chamber. Means is provided for introducing the oxidizing agent, which is a vapor or gas into the chamber. Pipe means associated with the chamber permits circulating the oxidizing gas or vapor into the chamber when required. There are means associated with the housing for introducing an aqueous fluid into the chamber and means for removing liquid from the chamber. The apparatus advantageously contains means for selectively controlling the laundering cycles including washing, extracting, desizing, etc. Preferably, the barrel is apertured and is provided with abrading means within the barrel.

The apparatus of the invention can be used to decolorize garments or fabrics having an oxidizable coloring agent by either placing an oxidizing gas in a liquid or treating the fabrics or garments with an oxidizing agent in a gaseous or vapor phase or both.

The apparatus is further capable of undergoing various laundering operations before or after treatment with an oxidizing agent, for example, desizing, extracting, washing and abrading.

The oxidizing agent can be gaseous or a liquid or a solid oxidant in a vapor state. Gaseous oxidizing agents include ozone, $NO_x$ and $SO_x$. These gases can be used alone, in admixture or diluted with a inert or low reactive gases such as air. The oxidizing gases can be used in combination with steam or in an aqueous system.

The non-gaseous oxidants should be used in a vapor phase, preferably with wetted fabrics. More preferably, the non-gaseous oxidants are used in combination with steam. Hydrogen peroxide solution diluted with steam is a preferred non-gaseous oxidant.

The oxidant, for example, ozone primarily reacts with the colorant on the fabric when the fabric is wet. Therefore, the garment is wetted or treated in a wet state. The water content of the wetted fabric when treated is about 5 to 75% by weight, more preferably about 20 to 40% by weight or higher depending upon the degree of treatment, the type of oxidant and the effect desired. The process is performed in a chamber in which the oxidant is generally present in an amount of about 10 to 1000 mg. per liter, more preferably about 10 to 100 mg per liter. The temperature in the chamber of about 40 to 100° C., preferably 50 to 65° C. Any excess oxidant emitted may be recycled back into the chamber or used to treat any effluent of the laundering process.

It is an object of the invention to provide an apparatus for use in a laundering operation to decolorize dyed garments or fabrics with an oxidant without degrading the fabric.

It is still further object of the invention to provide an apparatus for selectively and/or evenly decolorizing or fading dyed garments to produce fashion garments.

It is another object of the invention to provide an apparatus for use in a laundering operation which can desize, wash, extract and provide an oxidant to decolorize a colorant of a fabric or garment in a single chamber.

Other objects and a fuller understanding of the invention will be had by referring to the following description and claims of a preferred embodiment, taken in conjunction with the accompanying drawings.

DESCRIPTION OF THE PREFERRED EMBODIMENTS

Figure 1:
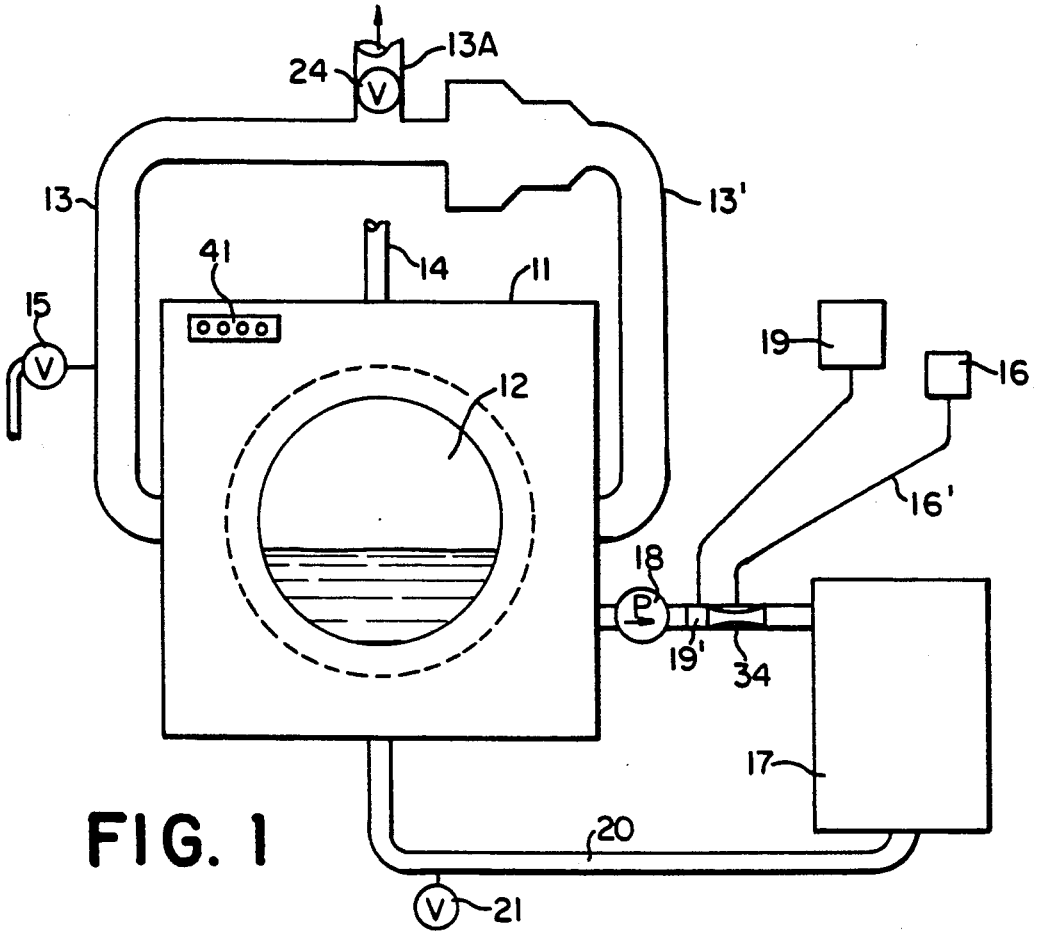
FIG. 1 is a front elevational view of the treatment apparatus of the invention.

Although specific terms are used in the following description for the sake of clarity, these terms are intended to refer only to the particular structure of the invention selected for illustration in the drawings and are not intended to define or limit the scope of the invention.

The apparatus of the invention will be next described in detail with reference to the annexed drawings. In the description that follows, the apparatus will be described particularly for use in connection with an oxidizing gas which is ozone. However, it should be understood that other types of oxidants may be utilized in the liquid as well as the vapor phase to decolorize the coloring agent present, particularly an oxidizable dye. Other suitable oxidants include chlorine, nitrous oxides and/or sulfur oxides.

For example chlorine when added to water produces hypochlorous acid (HOCl). Even under alkaline conditions a portion of the sodium hypochlorite (NaOCl) exists as the hypochlorous acid. For example in the study by Ridge and Little (J. Text. Inst., 1942, 33T, p. 59) the equilibria at different pH values are governed by the reactions:

$$HOCl \rightarrow H^+ + OCl^-$$

and $$HOCl + H^+ + Cl^- \rightarrow Cl_2 + H_2O$$

The fraction of the hypochlorite existing as free hypochlorous acid increases as the pH falls below 10. At pH of 5, all of the chlorine is in the hypochlorous acid form. Under neutral conditions about 73% exists in this form. Thus, chlorine added to neutral or slightly acidic steam will contain high amounts of oxidant as hypochlorous acid. Areas of the fabric which may need to be protected from the oxidizing effects of the hypochlorous acid can be coated with a preferential reaction product (blocking agent) such as starch. That is, the starch will be preferentially attacked by the hypochlorous acid and the underlying substrate (cotton, rayon etc.) will be protected and not undergo any significant bleaching or decolorization. Also, if the fabric is wet, chlorine gas will primarily react with the water to form HOCl according to the reaction:

$$H_2O + Cl_2 \rightarrow HOCl$$

and will bleach the fabric only in the wet areas. If dyed wool is to be processed by this method it may be satisfactory to use sulfur dioxide in the steam to achieve the same bleaching effect that chlorine will have on the non-wool garment.

Another oxidant that will be somewhat soluble in the steam is peracetic acid. It is used primarily as a bleaching agent for nylon.

Figure 2:
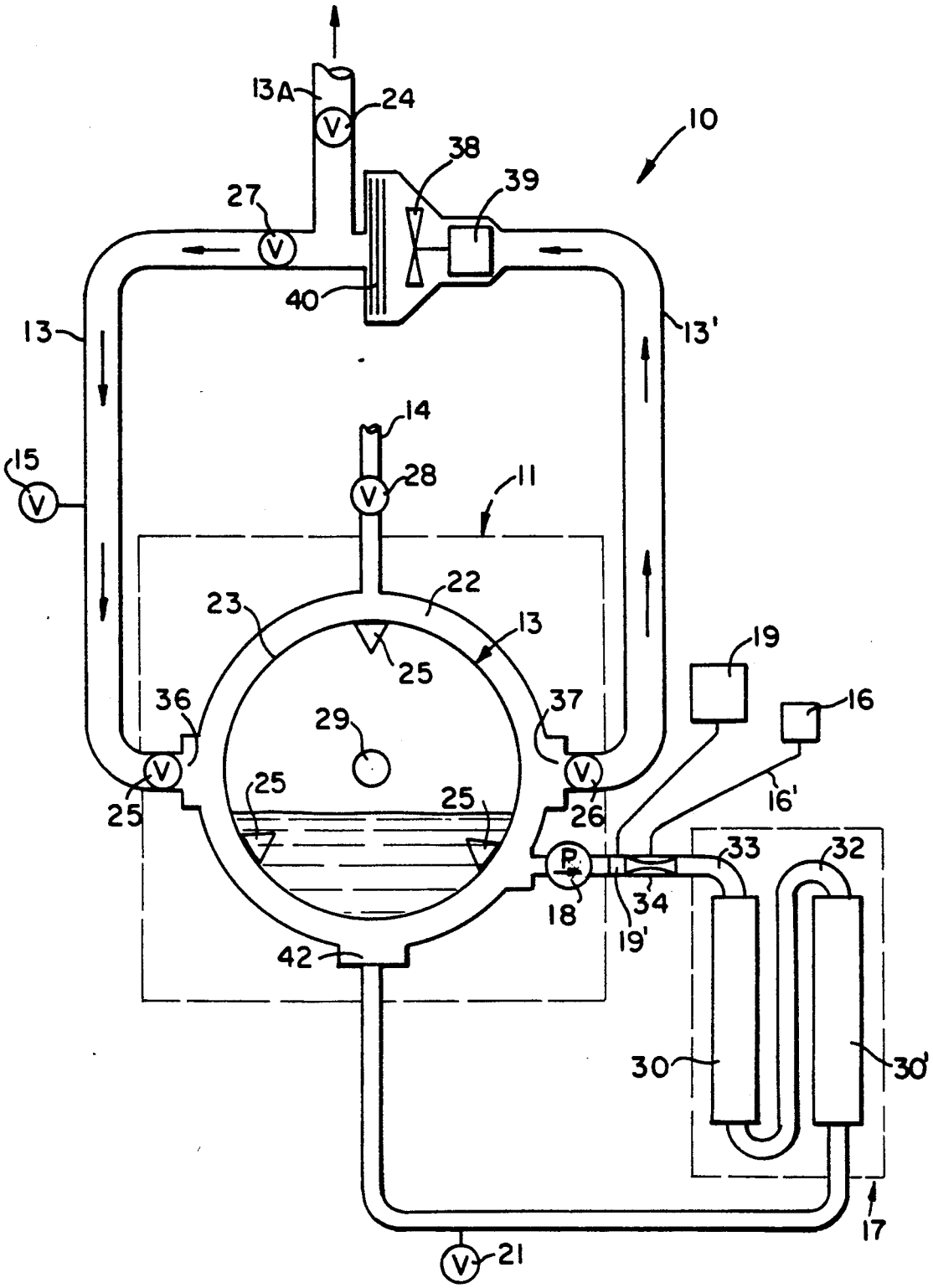
FIG. 2 is an isometric cross-sectional view of the apparatus of FIG. 1.

As seen in FIGS. 1 and 2, an apparatus 10 of the invention includes a housing 11 having an ozone-resistant treatment chamber 22. In the chamber 22 is an apertured drum or barrel 23 which is mounted on a rotor 29 for rotation by a motor (not shown). The motor is preferably a variable speed motor. The variable speed motor allows a tumbling and extracting cycle. A gas-tight door 12 permits placement of garments or fabrics into the chamber. A glass door is preferred so as to allow for inspection of the degree of decolorization of the fabric or garments.

Preferably, the barrel 23 is provided along its interior with the abrading means 25 which has several utilities. The abrading means 25 normally functions to abrade the fabrics or garments to provide a fashion appearance to the fabric or garment. The abrading means 25 during a desizing cycle assists in removing sizing in combination with an enzyme or ozone as the desizing agent. The abrading means 25 also acts as a tumbler during a washing cycle. The abrading means 25 may comprise inert roughening material such as pumice stone or aluminum diamond plates.

At the lower portion of the chamber 22 is a drain 42 to remove liquid from the chamber 22. Associated with the drain is a pipe 20 having a valve 21 for discharging liquid when it is opened and causing liquid from the chamber to be recycled when it is closed. The pipe 20 passes the liquid from the chamber 22 to a mixing device 17. The device 17 comprises a pair of mixers 30,30' for mixing the recycled liquid and ozone from the drain 42. Mixer 30' is connected to mixer 30 through line 22 which passes the mixture of gas and liquid through line 33 to a venturi 34. The venturi 34 is further connected to the ozone generator 16 through line 16'. The liquid-ozone mixture which passes through the venturi 34 is detected in line 33 by a probe 19' of an oxidation redox potential monitor 19 before it passes into a water pump 18. The water pump 18 then passes the mixture into the chamber 22. The water pump 18 preferably is capable of circulation of about 40 g.p.m.

The mixers 30,30' can comprise baffles or swirl means such as the polyolefin saddles sold by Jagger Corporation under the trademark NORPAC.

The water level within the chamber 22 when the apparatus is used in a wash cycle is generally about mid-way of the chamber 22. Above the water level in the chamber 22 is a gas outlet 37 which is associated with an outlet pipe 13' having a valve 37 in its entrance. The pipe 13' carries gas or vapor flow to a fan 38 which is operated by a motor 39. Steam or electric heater means 40 in association with the fan 38 may be used when heat or steam are to be added to the chamber 22. By control of valve 24 in exhaust 13A and valve 27 in line 13 the gas or vapor in the chamber may either be exhausted or recirculated.

In the recirculation operation, valve 24 is closed and the gas or vapor from chamber 22 passes into line 13 and through valve 25 in inlet 36 which is in the open position. Optionally, there is provided a valve 15 which vents the gas into a destruction chamber (not shown) or to a recycling line that transfers the gas for use to treat effluent in different areas of the laundering plant.

A control means 41 provides electronic control of the valves, water, ozone, etc., depending upon the different operation required. For example, the apparatus can be operated to extract, wash, emit steam alone or with ozone, etc.

Figure 3:
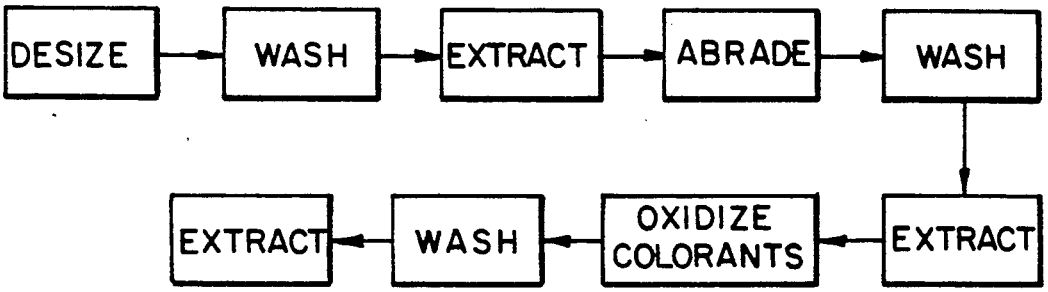
FIG. 3 is a schematic view of a process utilizing the apparatus of FIG. 1.

FIG. 3 schematically represents the different modes of operation that the apparatus of FIGS. 1 and 2 can undergo. In an operation of the apparatus, the apparatus can start with a desizing operation using ozone or desizing enzymes alone or in combination or in sequence. The desizing is followed by a wash cycle and then an extraction cycle. A control of the valves permits the different cycles to occur. The fabrics or garments can be abraded using the abrading means of the apparatus alone or in combination with abrading stones. The abrading step is followed by a washing and extraction step. The garments or fabrics can then be treated with an oxidizing gas such as ozone to oxidize a colorant or dye in several different ways. For example, wet fabric or garments can be tumbled in an ozone atmosphere. In many cases involving yellowing from an acid wash operation, this procedure is sufficient. Otherwise, the fabrics or garments can be tumbled in an atmosphere of ozone and steam or in an aqueous medium containing ozone.

Depending upon the process used, the fabrics or garments can washed and/or extracted. The effluent from the wash or extract containing ozone can be recycled or used to treat effluent in other operations.

Figure 4:
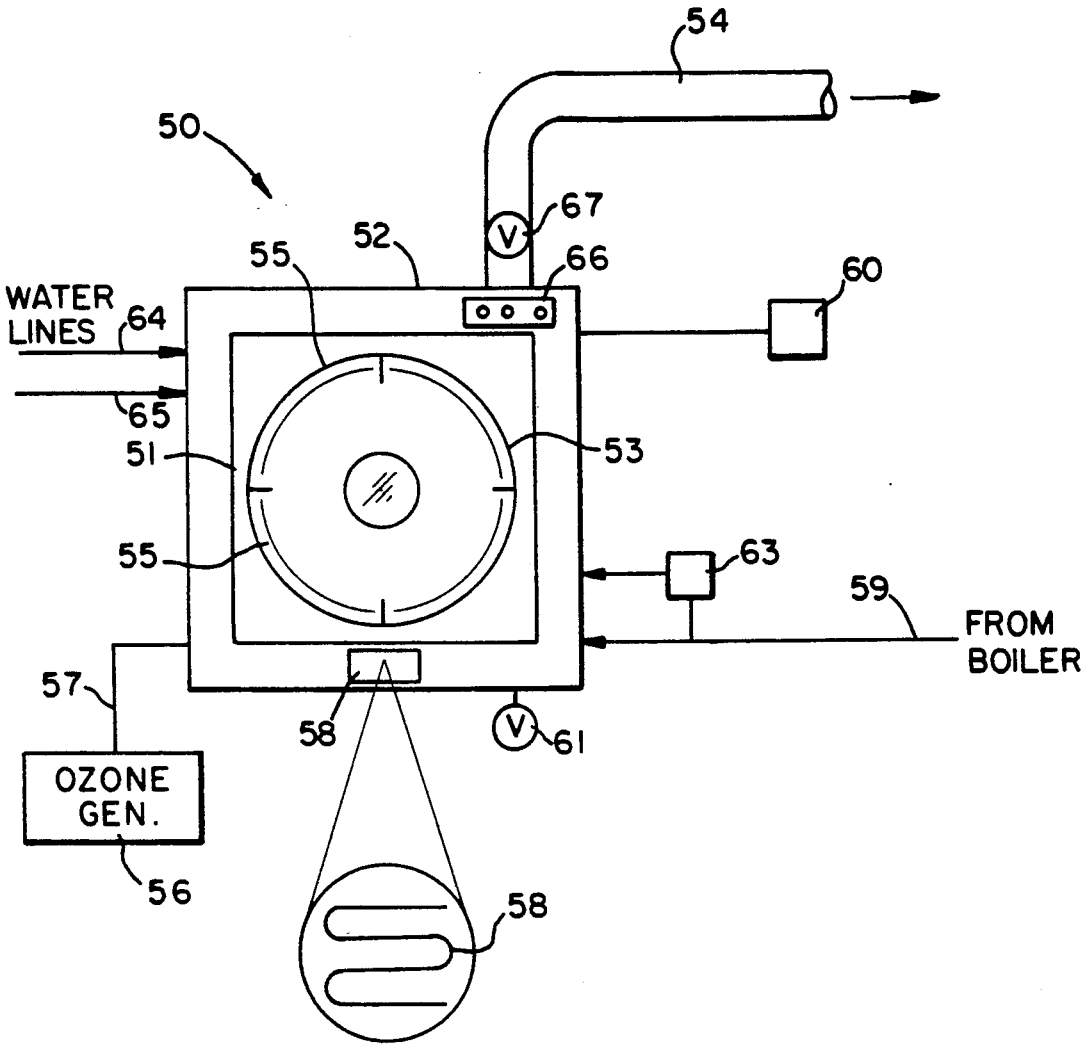
FIG. 4 is a front elevational view of another apparatus of the invention.

FIG. 4 illustrates another embodiment of the invention wherein an apparatus 50 is provided with a housing 52 which contains an airtight chamber 55 that is closed by a glass door 51. The chamber 55 may be fabricated from any airtight material unreactive to ozone, such as stainless steel, aluminum, Teflon, polyvinyl chloride, polyethylene, polypropylene, and the like. It is usually desirable to cover chamber 55 with a conventional insulating material to minimize the loss of heat through its walls.

Within the chamber 55 is a rotary apertured drum 53 which is rotated by a variable speed motor (not shown). The housing 52 at the lower portion of the chamber is provided with a heating means 58 and a drain valve 61.

Hot and cold water is fed into the chamber 55 by means of hot water pipe 64 and cold water pipe 65 which are associated with chamber 55. Also associated with chamber is a line 57 from an ozone generator 56 and a steam line 59. Associated with both the steam line 59 and the chamber 55 is a temperature control means 63. An ozone monitor and controller 60, such as model LC-12 manufactured by PCI Ozone and Control Systems Inc., West Caldwell, N.J., monitors the free ozone within the chamber 55. A control unit 66 on the apparatus 50 is utilized to control the different operations of the apparatus including control of the valves such as valve 67 in the vent 54.

In operation of the apparatus 50 of FIG. 4, denim garments with sizing are placed into the apparatus 50 via the chamber door 51. The denim garments can be dry prior to being placed inside the unit. Water is then added to the unit (hot, warm or cold water can be used depending on the desired garment finish). Detergent may be added to the unit, ozone gas is injected into the unit to remove the sizing during the wash cycle. The ozone gas is conveyed from the ozone generator 56 to the ozone chamber 55 by means of a 304 stainless steel tube 47. The ozone concentration in the unit is monitored by a ozone monitor and controller 60. The water temperature is maintained by the steam injector line 59 from a boiler (not shown) which is controlled by a temperature probe and controller 63. The prewash cycle using ozone to remove the sizing also decolorizes the garment to a lessor degree so as to start the decolorization process. Also during this process (prewash), abrasive material can be added to the unit 50 to abrade the garment. The sizing material and abrasion of the garment takes place when the rotating drum 53 is activated. After the prewash cycle the wash water is removed through a dump valve 61. Because of the demand for the ozone gas during this cycle is little or none, ozone is released through the dump valve 61. However, if the ozone monitor 60 indicates an unacceptable level of ozone remaining in the unit, the gas can be drawn off through the ozone vent 54 to be destroyed by an ozone destruction unit (not shown) or transferred to a waste water effluent for water treatment. The next step is a rinse cycle or a wash cycle depending on the garment finish requirements and the amount of oxidized dye and sizing remaining in the garment. During this cycle the unit is filled with water (hot, warm or cold, depending on the required garment finish) and the drum 53 is activated for approximately five minutes upon completion of this wash cycle, if required. The water is again removed by means of a dump valve 61. If the wash cycle is not required, a rinse cycle is used to remove the oxidized dye and sizing material. The rinse cycle may utilize hot, warm or cold water. After the rinse cycle, the water is again removed by means of the dump valve 61. The unit is then run through the extract cycle to remove excess water. The excess water is also removed through the dump valve 61. After the extract cycle, the drum 53 is activated to a low speed (tumble speed) depending on the desired garment finish and heat may or may not be applied at this time. Ozone is injected into the unit during this tumble cycle. It is during this cycle that the majority of the decolorization takes place. Also during this cycle, the abrasive material continues to abrade the garments during the decolorization process, if this is a desired finish. If heat is used during this cycle, it can range from 75 F 400 to F. Hereagain, depending on the finish, this decolorization cycle can take from approximately 3 minutes to 120 minutes, again depending on the required garment finish. After the decolorization cycle, the machine is filled with water and a small amount of detergent and fabric softener is added to remove the oxidized dye and soften the garments. A rinse cycle then follows to remove any detergent and fabric softener that still remains in the garments. Ozone may or may not be used in these last two cycles. The garments are then processed as usual from this point.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. An apparatus for laundering and selectively treating a garment or fabric with an oxidizing gas in combination with a liquid or steam which comprises:

a housing having a chamber, said chamber having a barrel mounted for rotation therein, means associated with said barrel for rotating said barrel in said chamber, door means on said housing for placing said garment or fabric into said chamber, means associated with said housing for selectively introducing either a controlled amount of oxidizing gas and steam into said chamber or a controlled amount of oxidizing gas and an aqueous liquid into said chamber, said means having a venturi which mixes said oxidizing gas and said liquid, and pipe means associated with said chamber for recirculating an oxidizing gas through and into said chamber, means for removing liquid from said chamber, and control means for selectively causing a cycle of a laundering operation to be performed.

2. The apparatus of claim 1 wherein said barrel is apertured.

3. The apparatus of claim 1 wherein said barrel is provided on its interior with means for abrading said garment or fabric.

4. The apparatus of claim 1 wherein said means for rotating said barrel comprises a variable motor.

5. The apparatus of claim 1 wherein said venturi is associated with an ozone generator.

6. The apparatus of claim 1 wherein said means for removing liquid from said chamber is associated with said venturi whereby liquid removed from the chamber is recirculated to said chamber through said venturi.

7. The apparatus of claim 1 wherein said means for introducing steam liquid into said chamber comprises a steam jet.

8. The apparatus of claim 1 wherein said means for introducing an aqueous liquid into said chamber comprises a water valve.

9. The apparatus of claim 1 including means for monitoring the amount of oxidizing gas in said chamber.

10. The apparatus of claim 1 including means for controlling the liquid level in said chamber.

11. The apparatus of claim 1 including means for heating said chamber.

12. An apparatus for laundering and selectively treating a garment or fabric with ozone in an aqueous liquid or steam environment which comprises:

a housing having a chamber, said chamber having an apertured barrel mounted for rotation therein;

motor means associated with said barrel for rotating said barrel in said chamber;

door means on said housing for placing said garment or fabric into said chamber;

means associated with said housing for selectively introducing either a controlled amount of liquid and ozone or selectively introducing steam and ozone into said chamber, said means having a venturi which mixes said ozone with said liquid;

pipe means associated with said chamber for circulating ozone into and through said chamber;

means for removing liquid from said chamber;

means for monitoring the amount of ozone within said chamber;

means mounted for heating said chamber, and control means for selectively causing a laundering operation to be performed.

13. The apparatus of claim 12 wherein said barrel is provided with abrading means.

14. The apparatus of claim 12 including means for recirculating the liquid removed from said chamber back into said chamber.

15. The apparatus of claim 12 wherein said motor means comprises a variable speed motor.

16. The apparatus of claim 12 including means for controlling the temperature control with said chamber.

* * * * *